US007014552B1

(12) United States Patent
Collier et al.

(10) Patent No.: US 7,014,552 B1
(45) Date of Patent: Mar. 21, 2006

(54) METHOD AND SYSTEM FOR CLEANING A POLISHING PAD

(75) Inventors: Ronald E. Collier, Lakeville, MN (US); Andrey Zagrebelny, Eagan, MN (US)

(73) Assignee: Cypress Semiconductor Corp., San Jose, CA (US)

( * ) Notice: Subject to any disclaimer, the term of this patent is extended or adjusted under 35 U.S.C. 154(b) by 792 days.

(21) Appl. No.: 09/899,871

(22) Filed: Jul. 6, 2001

(51) Int. Cl.
*B24B 1/00* (2006.01)

(52) U.S. Cl. ..... 452/56; 451/41

(58) Field of Classification Search ..... 457/56, 457/289, 444, 443, 60, 285–288, 41
See application file for complete search history.

(56) References Cited

U.S. PATENT DOCUMENTS 5,578,529 A * 11/1996 Mullins ..... 451/287
5,716,264 A * 2/1998 Kimura et al. ..... 451/41
5,997,392 A * 12/1999 Chamberlin et al. ..... 451/287
6,273,790 B1 * 8/2001 Neese et al. ..... 451/38
6,283,840 B1 * 9/2001 Huey ..... 451/288
6,284,092 B1 * 9/2001 Manfredi ..... 156/345.12
6,475,070 B1 * 11/2002 White ..... 451/59

* cited by examiner

*Primary Examiner*—Lee D. Wilson
(74) *Attorney, Agent, or Firm*—Kevin L. Daffer; Mollie E. Lettang; Daffer McDaniel, LLP

(57) ABSTRACT

A method and a system are provided for removing matter adhered to such a polishing pad. In particular, a polishing system is provided which is adapted to remove matter adhered to a polishing pad during a polishing process of a semiconductor topography. The polishing system may include a polishing pad and a spray element, which is preferably adapted to spray a pressurized fluid upon the polishing pad to remove matter adhered to the pad. In addition, a spray element is provided which may be adapted to be positioned within a polishing system. Such a spray element may be adapted to remove matter adhered to a polishing pad within the system by spraying a pressurized fluid upon the polishing pad. In addition, methods for cleaning a polishing pad during a polishing process and polishing multiple semiconductor topographies using the systems described herein are provided.

18 Claims, 4 Drawing Sheets

METHOD AND SYSTEM FOR CLEANING A POLISHING PAD

BACKGROUND OF THE INVENTION

1. Field of the Invention

This invention relates to semiconductor device manufacturing, and more particularly, to an improved method and system for removing matter adhered to a polishing pad.

2. Description of the Related Art

The following descriptions and examples are not admitted to be prior art by virtue of their inclusion within this section.

Fabrication of an integrated circuit involves numerous processing steps. For example, after implant regions (e.g., source/drain regions) have been placed within a semiconductor substrate and gate areas defined upon the substrate, alternating levels of interlevel dielectric and interconnect may be placed across the semiconductor topography to form a multi-level integrated circuit. Such a multi-level integrated circuit may include a plurality of layers and structures. Forming substantially planar upper surfaces of the semiconductor topography during intermediate process steps of the process may facilitate fabrication of layers and structures that meet design specifications. More specifically, forming a substantially planar surface may aid in forming layers and structures that meet the elevational and lateral design specifications of subsequently formed semiconductor devices.

Forming substantially planar upper surfaces during intermediate steps of a fabrication process may play an important role in the functionality of a semiconductor device. For example, problems with step coverage may arise when a dielectric, conductive, or semiconductive material is deposited over a topological surface having elevationally raised and recessed regions. Step coverage is defined as a measure of how well a film conforms over an underlying step and is expressed by the ratio of the minimum thickness of a film as it crosses a step to the nominal thickness of the film over horizontal regions. Furthermore, substantially planar surfaces may become increasingly important as the feature sizes of semiconductor devices are reduced, since the depth of focus required to pattern an upper surface of a semiconductor topography may increase with reductions in feature size. If a topography is non-planar, the patterned image may be distorted and the intended structure may not be formed to the specifications of the device. Furthermore, correctly patterning layers upon a topological surface containing fluctuations in elevation may be difficult using optical lithography. The depth-of-focus of the lithography alignment system may vary depending upon whether the resist resides in an elevational "hill" or "valley" area. The presence of such elevational disparities therefore makes it difficult to print high resolution features.

One manner in which to reduce elevational disparities of layers and structures formed during intermediate steps of a fabrication process is by polishing the layers and structures. Such a process may be performed by a fixed abrasive polishing process or a process referred to as chemical-mechanical polishing ("CMP"). A conventional polishing process may involve placing a semiconductor wafer face-down on a polishing pad which lies on or is attached to a backing structure. During the polishing process, the polishing pad and/or semiconductor wafer may be set in motion as the wafer is forced against the pad. For example, the polishing pad and the wafer may be placed on a rotatable table such that the wafer and the polishing pad may be rotated relative to each other. Alternatively, the wafer may be rotated relative to a fixed pad or vice versa. In another embodiment, the polishing pad may be a belt, which traverses against a fixed or rotating wafer. In either embodiment, the rotatable table, fixed pad, or belt may serve as the backing structure to which the polishing pad lies upon or is attached.

A fluid-based chemical suspension may be deposited onto the surface of the polishing pad as the pad and/or wafer is set in motion. The movement of the pad and/or wafer may distribute the fluid within the space between the polishing pad and the wafer surface such that debris polished from the surface of the wafer surface may be washed away. In a CMP process, the fluid is often referred to as a "slurry" and typically contains abrasive particles with which to physically strip the reacted surface material of the wafer. In this manner, the CMP process may employ a combination of chemical stripping and mechanical polishing to form a relatively level surface. Alternatively, the polishing fluid may be substantially absent of such abrasive particles, such as with fixed abrasive systems. In addition or alternatively, the pad itself may physically remove some material from the surface of the wafer. The polishing pad may include a textured upper surface with which to polish the topography. In addition, the polishing pad may include a plurality of pores dispersed across the entirety of the pad. The slurry applied to the polishing pad during the polishing process may fill the pores such that the majority of the fluid may be kept within the vicinity of the pad.

When used to planarize a semiconductor wafer surface, a polishing system has at least two important performance factors: (i) polishing removal rate, and (ii) resultant semiconductor wafer surface planarity or "uniformity". A high polishing rate is desirable in order to maximize the number of wafers which may be planarized in a given amount of time. A high measure of resultant semiconductor wafer surface planarity or "uniformity" is desirable to reduce the step coverage and depth of focus problems described above. Such a measure of uniformity may be measured across a single wafer or between multiple wafers.

Unfortunately, the polishing rate performance of polishing systems and the resultant uniformity of wafers polished by such systems degrades as matter builds up in the pores and on the upper surface of the polishing pad during the polishing process. The matter may include particles from the polishing fluid or from the polished wafer. As the polishing chemistry is exposed to air during the polishing process, the liquid portion of the fluid evaporates leaving polishing solution particles and wafer particles to clog the pores of the polishing pad. The slurry particles, in particular, tend to agglomerate forming large masses adhered to the polishing pad. Such clogging restricts the amount of slurry that is able to fill the pores and consequently limits the amount of slurry that may be contained within the vicinity of the polishing pad. In addition or alternatively, the matter may accumulate or agglomerate upon the upper surface of the pad. Such an accumulation may be referred to as "glazing" and essentially smoothes out the textured surface of the pad, thereby reducing the effectiveness of the polishing pad. Consequently, the efficiency and performance of a polishing system may be adversely affected by matter adhered to the polishing pad of the system.

In order to increase the effectiveness of a polishing pad in a polishing system, the polishing pad may be cleaned periodically. Such a process is typically a sporadic manual process which involves shutting down the polishing system and depositing water upon the pad in an effort to suspend the particles in solution and subsequently wash them away. Unfortunately, such a process typically does not remove all matter from the pad. More specifically, the conventional cleaning process may only be able to suspend matter loosely adhered to the polishing pad. As such, the current cleaning process may not be able to dislodge all matter adhered to the polishing pad. Consequently, the polishing performance and efficiency of the system may degrade more quickly since additional matter may build upon the remaining matter. In addition, such a cleaning process is typically performed when the polishing system is not in use. Typically, in order to reduce downtime of the polishing system, the cleaning process is performed after a specific number (e.g., 25) of wafers has been processed. In this manner, as the polishing process continues, matter continues to accumulate upon the polishing pad and uniformity from wafer to wafer decreases. Furthermore, since the process is manual, the length and the coverage of the cleaning process may vary. As such, the performance and efficiency of the polishing system may vary, thereby reducing the process capability of the system.

Accordingly, it would be advantageous to develop a method and a system for removing matter adhered to a polishing pad during the use of a polishing system.

SUMMARY OF THE INVENTION

The problems outlined above may be in large part addressed by a method and a system for cleaning a polishing pad of a polishing system. In particular, a method and system are provided for removing matter adhered to such a polishing pad. A polishing system is provided which is adapted to remove matter adhered to a polishing pad during a polishing process of a semiconductor topography. The polishing system may include a polishing pad and a spray element, which is preferably adapted to spray a pressurized fluid upon the polishing pad to remove matter adhered to the pad. In addition, a spray element is provided which may be adapted to be positioned within a polishing system. Such a spray element may be adapted to remove matter adhered to a polishing pad within the system by spraying a pressurized fluid upon the polishing pad. In addition, methods for cleaning a polishing pad during a polishing process and polishing multiple semiconductor topographies using the systems described herein are provided.

The term "spray" as described herein may refer to the state in which the fluid is dispersed. In particular, the term "spray" may refer to a fluid that is under greater pressure after passing through a nozzle of the spray element than before traversing through such a nozzle. In some embodiments, the term "spray" may refer to the projection of the fluid from the spray element. For example, "spray" may refer to a stream of finely divided streams, particles, or droplets. Moreover, "spray" may refer to a stream projection with a cross section that increases in width as it dispenses from the nozzle of the spray element. In either embodiment, the term "pressurized fluid" may refer to a fluid under a sufficient amount of pressure with which to cause the fluid to spray. This is distinctly different from a dispense element which does not include sufficient pressure to "spray" the fluid. In such an embodiment, the fluid is dispensed in a continuous stream and is generally at the same pressure as the supply source.

As stated above, a polishing system is provided which includes a polishing pad and a spray element adapted to spray a pressurized fluid upon the polishing pad to remove matter adhered to the pad. The polishing system is preferably adapted to allow the pressurized fluid to be dispensed across the entirety of the polishing pad. More specifically, the polishing system is preferably adapted to allow the pressurized fluid to come in contact with every portion of the polishing pad at least once during each activation of the spray element. For example, the polishing pad may be adapted to move such that every part of the pad may traverse under the spray element. In addition, the spray element may be positioned across at least half of the width of the polishing pad. For example, in an embodiment in which the polishing pad includes a circular pad, the spray element may extend across the radius of the polishing pad. In an alternative embodiment in which the polishing pad includes a belt, the spray element may extend across the width of the belt. In addition, the spray element may be adapted to be removed from the system. In this manner, the components of the system may be easily accessed.

The system may further include a dispense component adapted to dispense a polishing fluid onto the polishing pad during the polishing process. The matter adhered to the polishing pad may be come adhered to the pad during the polishing process of a semiconductor topography. As such, the matter may include particles from the polishing fluid and/or from the polished semiconductor topography. The matter may accumulate and adhere to the pad, thereby glazing or coating the upper surface of the pad. In addition or alternatively, the polishing pad may include a plurality of pores, and a portion of the matter may be embedded within one or more of the pores.

In an embodiment, a spray element may be adapted to be positioned within a polishing system. Such a spray element may be further adapted to remove matter adhered to a polishing pad of the system by spraying a pressurized fluid upon the polishing pad. In particular, the spray element may be adapted to be positioned within the polishing system such that the pressurized fluid is dispersed within a region extending across at least half of the width of the polishing pad. The spray element may include a plurality of nozzles arranged such that the nozzles are projected toward the polishing pad upon positioning the spray element to the system. The plurality of nozzles are preferably arranged such that a spray distribution from one of said plurality of nozzles overlaps a spray distribution from an adjacent nozzle. In addition, the spray element may include shields arranged about the plurality of nozzles. The shields may be arranged along the sides of the spray element parallel to the projection of the nozzles. In some embodiments, the spray element may include a mounting structure with which to couple the spray element to the polishing system.

A method for cleaning a polishing pad may include moving the polishing pad relative to a spray element. In such an embodiment, the spray element and polishing pad may be positioned within a polishing system such that fluid openings of the spray element are positioned toward the polishing pad. The method may further include spraying a pressurized fluid from the spray element upon the polishing pad while moving the polishing pad. Preferably, the duration of such spraying is sufficient such that the pressurized fluid is dispensed upon the entire upper surface of the polishing pad. In addition or alternatively, spraying may include spraying the fluid at a sufficient pressure to dislodge the matter adhered to the polishing pad. For example, spraying may include spraying the fluid at a pressure between approximately 25 psi and approximately 45 psi. Consequently, the method may include removing matter adhered to the polishing pad. In some embodiments, spraying may be conducted after polishing one or more semiconductor topographies with the polishing system. Alternatively, spraying may be conducted while polishing the one or more semiconductor topographies.

In addition, a method for polishing multiple semiconductor topographies is provided herein. Such a method may include moving a polishing pad with respect to a semiconductor topography and a spray element. The semiconductor topography may then be polished by positioning it against the moving polishing pad. The method may further include spraying a pressurized fluid from the spray element upon the polishing pad while continuing to move the polishing pad. In addition, the method may include removing matter adhered to the polishing pad. Such a method may further include polishing one or more additional topographies and repeating the spraying and removing steps after polishing one or more of the additional topographies. Furthermore, spraying may be conducted at a predetermined time. For example, spraying may be conducted after polishing. Alternatively, spraying and polishing may be conducted simultaneously. The method may further include applying a polishing fluid from a dispense component prior to polishing the semiconductor topography.

There may be several advantages to creating a method and system to remove the build-up of matter upon a polishing pad during a CMP process. For example, the fact that the system is incorporated into the CMP process may minimize interruption of the polishing process. Consequently, production throughput may be increased. In addition, the spray element included in such a system is preferably adapted to spray a fluid at a sufficient pressure such that essentially all of the matter is removed from the pad. In this manner, the pad may be cleansed completely before polishing one or more wafers. Conventional methods typically do not remove all of the matter on a pad, thereby jeopardizing the quality of the subsequent polishing process. Furthermore, the process described herein does not require manual intervention. In other words, the activation, length, and coverage of the process may be maintained in a consistent manner. In this manner, the pad may be consistently cleaned in the same manner. The variation attributed with the manual process is eliminated, thereby improving the process capability of the cleaning process and consequently the polishing process. Another advantage of the system as described herein is that it is configured to easily mount into the polishing system along with being very easy to remove. In this manner, the tool may be easily accessed for maintenance issues.

BRIEF DESCRIPTION OF THE DRAWINGS

Other objects and advantages of the invention will become apparent upon reading the following detailed description and upon reference to the accompanying drawings in which.

Figure 1:
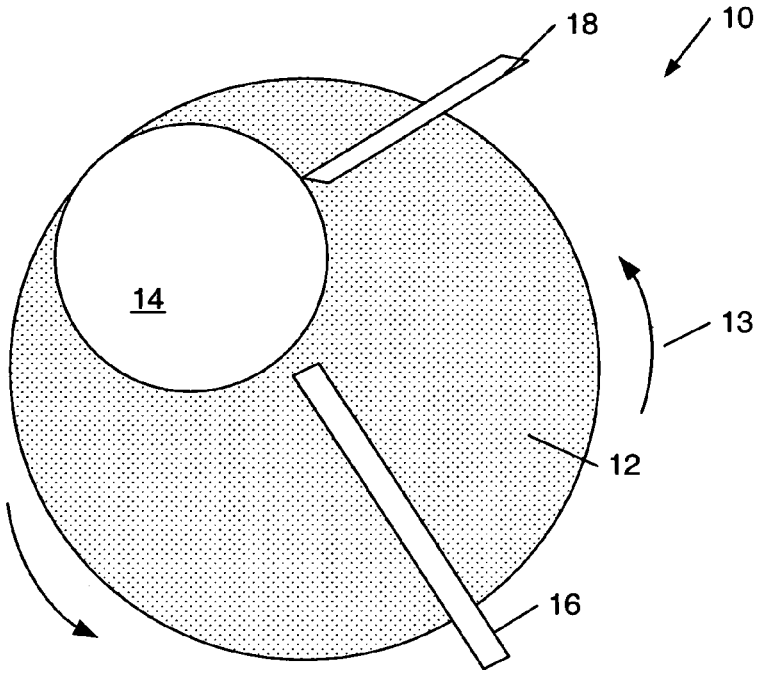
FIG. 1 depicts a partial top view of a polishing system in which a spray element is positioned across the radius of a polishing pad.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning to the drawings, an exemplary embodiment of a polishing system for processing a semiconductor topography according to the method as described herein is illustrated in FIG. 1. In particular, a partial top view of polishing system 10 is shown with polishing pad 12 positioned below semiconductor topography 14 and spray element 16. Polishing pad 12 may include a variety of materials depending on the process specifications of the fabrication process and/or design specifications of the subsequently formed semiconductor devices. In particular, materials used for polishing pad 12 may vary in hardness and surface texture depending on the design specifications of the polished topography and the process capabilities of the polishing system. For example, a CMP polishing system which has a polishing pad with an abrasive surface may have a higher ratio of mechanical polishing action versus chemical polishing. Moreover, a polishing system with a polishing pad that is particularly hard may more quickly form a substantially planar surface than one with a softer pad material since the harder pad is less likely to conform to the elevational disparities of the semiconductor topography. Examples of popular polishing pad mediums include polyurethane or polyurethane-impregnated polyester felts.

In some embodiments, polishing pad 12 may include a plurality of pores dispersed across the entirety or a portion of the pad. Furthermore, polishing pad 12 may include a variety of shapes and sizes. For example, polishing pad 12 may be circular, square, or rectangular. The size of polishing pad 12 may depend on the size of the polishing system, but generally may range from approximately 10 inches to approximately 30 inches in diameter, length, or width. In FIG. 1, polishing pad 12 is circular and may range between approximately 20 inches and approximately 30 inches in diameter. In some embodiments, polishing pad 12 may be configured to move. In FIG. 1, polishing pad 12 is configured to rotate in direction 13. Alternatively or in addition, polishing pad 12 may be configured to rotate in the opposite direction of direction 13. The rate of revolution of polishing pad 12 may vary depending on the design specifications of polishing system 10. In general, the revolution rate of polishing pad 12 may be between approximately 10 rpm and 90 rpm.

Semiconductor topography 14 is preferably positioned within polishing system 10 such that its upper surface is facing polishing pad 12. Since FIG. 1 is a top view of polishing system 10, the bottom surface of semiconductor topography 14 is shown. The upper surface of semiconductor topography 14 may be polished by the system as described herein in an effort to form a substantially planar upper surface, reduce the thickness of an upper layer of the topography, and/or remove surface irregularities of semiconductor topography 14. Semiconductor topography 14 may include one or more layers, such as dielectric or metallization layers, formed upon a semiconductor substrate. In addition or alternatively, semiconductor topography 14 may include one or more structures, such as gate structures, contact structures, and local interconnect wires, formed upon or within a semiconductor substrate. FIG. 1 illustrates semiconductor topography 14 aligned along the edge of polishing pad 12. However, semiconductor topography 14 may be positioned above any region of polishing pad 12 as long as the entire topography is above the pad. In addition, polishing system 10 may include one or more semiconductor topographies arranged above polishing pad 12. Such a system may simultaneously polish a plurality of topographies.

Typically, a semiconductor topography is suspended above a polishing pad by a wafer carrier. The wafer carrier and/or polishing pad may be adapted to move such that the semiconductor topography may be positioned against the polishing pad during polishing. Likewise, the wafer carrier and/or polishing pad may be adapted to move such that semiconductor topographies may be loaded and unloaded easily. In addition, the wafer carrier may be adapted to move such that the semiconductor topography moves relative to the polishing pad during the polishing process. For example, a wafer carrier may be adapted to rotate semiconductor topography 14 in the opposite direction of direction 13. Alternatively, a wafer carrier may be adapted to rotate semiconductor topography in direction 13. FIG. 1 does not illustrate such a wafer carrier for simplification, but it is noted that polishing system 10 may include such a carrier.

As stated above, polishing system 10 may also include spray element 16. Spray element 16 is preferably adapted to spray a pressurized fluid upon polishing pad 12 to remove matter adhered to the pad. Such matter may be adhered to the pad during polishing of semiconductor topography 14. More specifically, such matter may include particles from a polishing solution added during the polishing process and/or portions of semiconductor topography 14 polished away by polishing system 10. Generally, as the polishing chemistry is exposed to air during the polishing process, the liquid portion of the fluid may evaporate leaving solution particles and wafer particles to clog the pores of polishing pad 12. The slurry particles in particular tend to agglomerate forming large masses adhered to the polishing pad. Such clogging restricts the amount of slurry that is able to fill the pores, thereby limiting the amount of slurry that may be contained within the vicinity of polishing pad 12. In addition or alternatively, matter may accumulate or agglomerate upon the upper surface of polishing pad 12. Such an accumulation may be referred to as "glazing" and may smooth out the textured surface of polishing pad 12, reducing the effectiveness of the polishing pad.

As will be described in more detail below in FIG. 3, spray element 16 is preferably adapted to spray a pressurized fluid upon polishing pad 12 to remove such matter. In some embodiments, spray element 16 may be adapted to spray a fluid at a pressure between approximately 25 psi and approximately 45 psi. The pressurized fluid within the system as described herein may contain any fluid such as gases, water, or chemical-based liquids. In an embodiment in which a chemical-based liquid is used, the chemical may contain a base or an acid, which is compatible with the material of the polishing pad. In a preferred embodiment, the fluid may include deionized water. In such an embodiment, the deionized water may be supplied from the same source as used to make the slurry. In this manner, a separate pump and fluid supply may not be needed. Such a configuration is advantageous for minimizing the number of components included in the polishing system.

The term "spray" as described herein may refer to the state in which the fluid is dispersed. In particular, the term "spray" may refer to a fluid that is under greater pressure after passing through a nozzle of the spray element than before traversing through such a nozzle. In some embodiments, the term "spray" may refer to the projection of the fluid from the spray element. For example, "spray" may refer to a stream of finely divided streams, particles, or droplets. Moreover, "spray" may refer to a stream projection with a cross section that increases in width as it dispenses from the nozzle of the spray element. In either embodiment, the term "pressurized fluid" may refer to a fluid under a sufficient amount of pressure with which to cause the fluid to spray. This is distinctly different from a dispense element which does not include sufficient pressure to "spray" the fluid. In such an embodiment, the fluid is dispensed in a continuous stream and is generally at the same pressure as the supply source.

In addition, polishing system 10 may be adapted to allow the pressurized fluid to be dispensed across the entirety of polishing pad 12. More specifically, polishing system 10 may be adapted to allow the pressurized fluid to come in contact with every portion of polishing pad 12 at least once during each activation of spray element 16. For example, polishing pad 12 may be adapted to move such that every part of the pad may traverse under spray element 16. In particular, polishing pad 12 may be adapted to rotate in direction 13 under spray element 16 as shown in FIG. 1. In addition, spray element 16 may be adapted to spray the pressurized fluid across at least half of the width of polishing pad 12. In this manner, the pressurized fluid may be distributed across polishing pad 12 as polishing pad 12 is rotated. As such, the pressurized fluid may come into contact with every portion of polishing pad 12. In one embodiment, spray element 16 may extend across the radius of polishing pad 12 as shown in FIG. 1. In another embodiment, spray element 16 may extend further along the diameter of polishing pad 12. In addition, spray element 16 may extend beyond the periphery of polishing pad 12 in order to secure the element to polishing system 10. Alternatively, spray element 16 may not extend beyond the periphery of polishing pad 12. Other configurations of polishing pad 12 and spray element 16 may be constructed to distribute the pressurized fluid across polishing pad 12. An example of such an embodiment is described and illustrated in FIG. 2 below.

In addition to being positioned to spray a pressurized fluid across a portion of polishing pad 12, spray element 16 may be adapted to be removed from polishing system 10. Such an adaptation may allow system 10 to be easily maintained for periodic inspections and maintenance repairs. In one embodiment, spray element 16 may be spaced adjacent to semiconductor topography 14, particularly in an area above a given portion of polishing pad 12 after semiconductor topography 14 (following the direction of the movement of polishing pad 12). In some embodiments, spray element 16 may be positioned relative to fixed object within polishing system 10 so that spray element 16 may be positioned in the same position each time. Alternatively, a placement indicator may be added to polishing system 10 so that spray element 16 may be positioned within the same position each time. Positioning spray element 16 in the same position within polishing system 10 may be advantageous for optimizing the process variables of the system. For example, the pressure and angle of the pressurized fluid may be optimized for a given position within polishing system 10.

In some embodiments, polishing system 10 may include dispense component 18 for dispensing a polishing fluid onto polishing pad 12 during the polishing process of semiconductor topography 14. The polishing fluid preferably includes a fluid-based chemical suspension with which debris from the polished topography may be washed away. In a CMP process, the fluid typically contains abrasive particles and is often referred to as "slurry." Such abrasive fluid particles may include, for example, silica, alumina, or ceria. The movement of polishing pad 12 and/or semiconductor topography 14 relative to each other may cause the abrasive particles entrained within the slurry to physically strip the reacted surface material of semiconductor topography 14. Alternatively, the polishing fluid may be substantially absent of abrasive particles as in a fixed abrasive system.

Dispense component 18 may be spaced adjacent to semiconductor topography 14, particularly in the area above a given portion of polishing pad 12 before the topography relative to direction 13. Typically, dispense component 18 is configured to dispense the polishing fluid in a direction substantially parallel to polishing pad 12 instead of perpendicular to the pad. In this manner, the slurry may be projected across polishing pad 12 to more quickly traverse between all areas of polishing pad 12 and semiconductor topography 14. In addition, dispense component 18 is generally adapted to dispense the polishing solution only in a pressure range between approximately 2.0 psi and approximately 5.0 psi. As such, the flow is advantageously dispensed as a continuous stream. The low dispense pressure may allow the polishing solution to be dispensed in a controlled manner. In addition, the low pressure may allow less of the polishing solution to be dispersed across other areas of polishing system 10.

Figure 2:
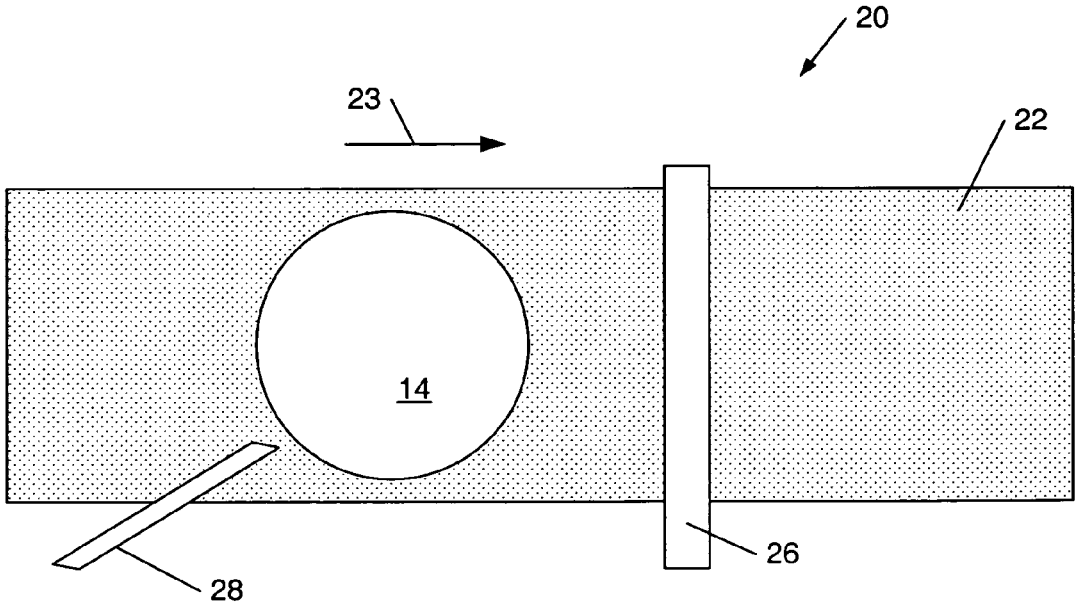
FIG. 2 depicts a partial top view of a polishing system, in an alternative embodiment, in which a spray element is positioned across the width of a polishing pad.

Another exemplary embodiment of a polishing system as described herein is illustrated in FIG. 2. In particular, polishing system 20 is shown within polishing pad 22 arranged below semiconductor topography 14, spray element 26, dispense component 28. In such an embodiment, polishing pad 22 may be a belt configured to traverse under semiconductor topography 14. For example, polishing pad 22 may be a flat piece of material configured to traverse back and forth under semiconductor topography 14. In another embodiment, polishing pad 22 may include a belt configured to revolve about a plurality of rollers. As such, polishing pad may move in direction 23 and/or in the direction opposite of direction 23. In some embodiments, both polishing pad 22 and semiconductor topography 14 may be adapted to move relative to each other. In particular, semiconductor topography 14 may be rotated relative to the movement of polishing pad 12.

Semiconductor topography 14 may be the same as that used in FIG. 1 and therefore may be positioned within polishing system 20 such that its upper surface is facing polishing pad 22. In addition, semiconductor topography 14 may be positioned above any region of polishing pad 22 as long as the entire topography is above the pad. Furthermore, polishing system 20 may include, in some embodiments, a plurality of topographies arranged above polishing pad 22. In addition, dispense component 28 may be similar to that of dispense component 18 of FIG. 1. In particular, dispense component 28 may be adapted to dispense a polishing fluid onto polishing pad 22 during the polishing process of semiconductor topography 14. In addition, dispense component 28 may be configured to dispense the polishing fluid at a low pressure and in a direction substantially parallel to polishing pad 22 in order to project the polishing fluid across the pad in an efficient and controlled manner. Dispense component 28 is preferably spaced adjacent to semiconductor topography 14, particularly above a portion of polishing pad 22 in an area reached before the topography relative to direction 23.

Polishing pad 22 may be similar to polishing pad 12 of FIG. 1. In particular, polishing pad 22 may include a variety of materials, which may vary in hardness and surface texture. Examples of popular polishing mediums include polyurethane or polyurethane-impregnated polyester felts. In some embodiments, polishing pad 22 may include a plurality of pores dispersed across the entirety of the pad. Furthermore, polishing pad 22 may have a variety of shapes and/or sizes. For example, polishing pad 22 may be a rectangular belt as shown in FIG. 2. The width of polishing pad 22, in such an embodiment, may depend on the size specifications of polishing system 20, but may, for example, range from approximately 12 inches to approximately 15 inches. The length of the belt may vary widely depending on the design of the polishing system, particularly if more than one semiconductor topography may be arranged above polishing pad 22.

Spray element 26 may be similar to that of spray element 16 of FIG. 1. In particular, spray element 16 may be adapted to spray a pressurized fluid upon polishing pad 22 to remove matter adhered to the pad. In particular, spray element 26 may be adapted to dispense a fluid under greater pressure after passing through a nozzle of the spray element than before traversing through such a nozzle. In some embodiments, spray element 26 may be adapted to dispense a stream of finely divided streams, particles, or droplets. Moreover, spray element 26 may be adapted to dispense a stream projection with a cross section that increases in width as it dispenses from the nozzle of the spray element. As such, pressurized fluid from spray element 26 may be under a sufficient amount of pressure with which to cause the fluid to spray. In addition, polishing system 20 may be adapted to allow the pressurized fluid to be dispensed across the entirety of polishing pad 22. More specifically, polishing system 20 may be adapted to allow the pressurized fluid to come in contact with every portion of polishing pad 22 at least once during a given activation of spray element 26. For example, polishing pad 22 may be adapted to move such that every part of the pad may traverse under spray element 26. In particular, polishing pad 22 may be adapted to move in direction 23 under spray element 26 as shown in FIG. 2.

In addition, spray element 26 may be positioned to spray the pressurized fluid across at least half of the width of polishing pad 22. In FIG. 2, spray element 26 may extend across the entire width of polishing pad 22 such that the pressurized fluid may come into contact with every portion of the pad during the polishing process. In addition, spray element 26 may extend beyond the edge of polishing pad 22 in order to secure the element to polishing system 20. Alternatively, spray element 26 may not extend beyond the edge of polishing pad 22. FIG. 2 illustrates only an exemplary embodiment of a configuration from which to distribute a pressurized fluid across polishing pad 22. As such, other configurations of polishing pad 22 and spray element 26 may be constructed to distribute the pressurized fluid across polishing pad 22.

In addition to being positioned to spray a pressurized fluid across a portion of polishing pad 22, spray element 26 may be adapted to be removed from polishing system 20. Such an adaptation may allow system 20 to be easily maintained for periodic inspections and maintenance repairs. In one embodiment, spray element 26 may be spaced adjacent to semiconductor topography 14, particularly above a portion of polishing pad 22 in an area reached after semiconductor topography 14 following the direction of the movement of polishing pad 22. In some embodiments, spray element 26 may be positioned relative to a fixed object within polishing system 20 so that spray element 26 may be positioned in the same position each time. Alternatively, a placement indicator may be added to polishing system 20 so that spray element 26 may be positioned within the same position each time. Positioning spray element 26 in the same position within polishing system 20 may be advantageous for optimizing the process variables of the system. For example, the pressure and angle of the pressurized fluid may be optimized for a given position within polishing system 20.

Figure 3A:
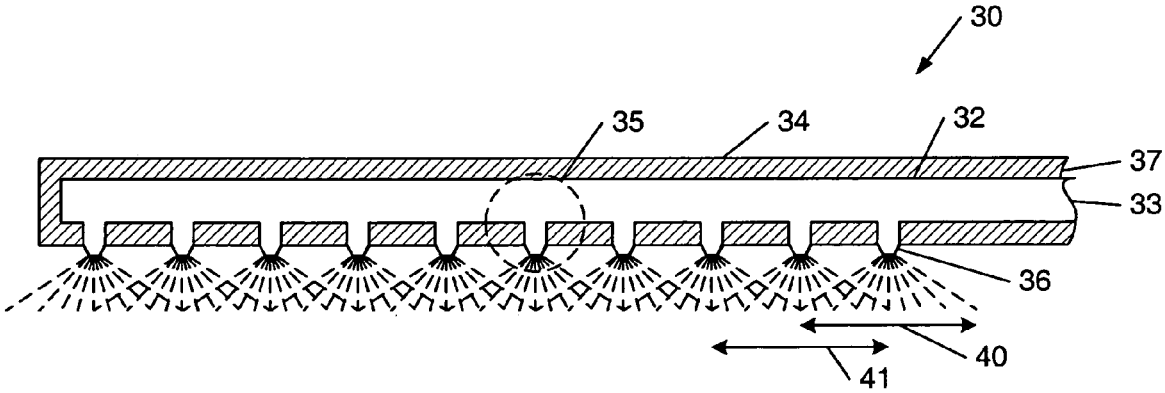
FIG. 3*a* depicts a partial cross-sectional view of the spray element used in the polishing systems of FIGS. 1 and 2.

An exemplary embodiment of a spray element that may be used in either of the embodiments of FIGS. 1 and 2 is illustrated in FIG. 3*a*. In particular, a cross-sectional side-view of spray element 30 is shown. Such a spray element is preferably adapted to be positioned within a polishing system. In particular, spray element may be positioned approximately 1 cm to approximately 3 cm above a polishing pad of the polishing system. Moreover, such a spray element may be adapted to remove matter adhered to the polishing pad by spraying pressurized fluid upon the polishing pad. Spray element 30 may include inner pipe 32 encompassed by outer casing 34. Outer casing 34 may serve to protect inner pipe 32. In an alternative embodiment, outer casing 34 may be omitted from spray element 30. In such an embodiment, inner pipe 32 may be exposed. In FIG. 3*a*, lateral surfaces 33 and 35 of inner pipe 32 and outer casing 34, respectively, are drawn to indicate the continuation of spray element 30. Such a continuation may contain other components of spray element 30. For example, inner pipe 32 may include a mechanism with which to couple to a fluid supply line. In addition, spray element 30 may include a flow control valve.

Spray element 30 may also include a plurality of nozzles 36 extending from inner pipe 32 from which pressurized fluid 38 may dispense. Spray element 30 may include any number of nozzles depending on the design specifications of the spray element. Such design specifications may include, for example, the length and width of spray element 30, the type of matter adhered to the polishing pad, and the size and shape of the polishing pad. In general, the pressure of the pressurized fluid may tend to decrease with an increase in the number of nozzles, thereby reducing the force at which the spray is dispersed. In addition, the coverage of the pressurized fluid decreases as the number of nozzles decrease. As such, the number of nozzles may be optimized such that the pressurized fluid may be dispensed at an adequate pressure and over the entirety of the polishing pad. In a preferred embodiment, spray element 30 may include between approximately 5 and approximately 20 nozzles. More preferably, spray element 30 may include approximately 10 nozzles.

Upon positioning spray element 30 to a polishing system, nozzles 36 are preferably arranged such that they are projected toward the polishing pad. In addition, nozzles 36 may be arranged such that the spray distribution of pressurized fluid 38 from each of the nozzles overlaps the spray distribution of pressurized fluid 38 from its respective adjacent nozzles. In particular, spray distribution 40 from one nozzle may overlap spray distribution 41 of an adjacent nozzle as shown in FIG. 3*a*. In one embodiment, nozzles 36 may be arranged such that spray distribution 40 from one nozzle may span across half of spray distribution 41 of an adjacent nozzle. Larger or smaller spray distributions may be used, however, depending on the design specifications of the spray element.

The spray distribution and pattern from nozzles 36 may largely depend on the type of nozzles used and the pressure of the fluid through the nozzles. In particular, a variety of nozzle types may be used depending on the design specifications of the spray element and the type of matter adhered to the polishing pad. For example, nozzles 36 may be configured to spray pressurized fluid 38 in a "fan" spray pattern as shown in FIG. 3*a*. In such an embodiment, portions of the spray patterns of pressurized fluid 38 may vary between approximately 0° and approximately 90° from a straight projection of pressurized fluid 38 through nozzles 36. More specifically, portions of the spray patterns of pressurized fluid 38 may vary between approximately 0° and approximately 45° from a straight projection of pressurized fluid 38 through nozzles 36. In an alternative embodiment, nozzles 36 may be configured to spray in a substantially straight spray pattern. In some embodiments, different types of spray nozzles may be incorporated in the same spray element. As such, nozzles with a fan spray pattern may be mixed with nozzles having a substantially straight spray pattern. In this manner, a spray element may be tailored for the polishing process used. More specifically, the spray element may be optimized to remove matter adhered to the polishing pad of the polishing process.

In addition, the pressure of the fluid may be contrived through the configuration of the nozzle. In particular, the restriction of flow through nozzles 36 may increase the pressure of the fluid such that the fluid is sprayed upon the polishing pad. The term "spray" as described herein may refer to the state in which the fluid is dispersed. In particular, the term "spray" may refer to a fluid that is under greater pressure after passing through a nozzle of the spray element than before traversing through such a nozzle. In some embodiments, the term "spray" may refer to the projection of the fluid from the spray element. For example, "spray" may refer to a stream of finely divided streams, particles, or droplets. Moreover, "spray" may refer to a stream projection with a cross section that increases in width as it dispenses from the nozzle of the spray element. In either embodiment, the term "pressurized fluid" may refer to a fluid under a sufficient amount of pressure with which to cause the fluid to spray. This is distinctly different from a dispense element which does not include sufficient pressure to "spray" the fluid. In such an embodiment, the fluid is dispensed in a continuous stream. In addition, the force at which such a fluid may contact a surface is significantly less than the force of a "pressurized fluid."

The pressure at which the fluid is dispensed and the angle at which the spray pattern is configured may be optimized such that the matter adhered to a polishing pad may be sufficiently and consistently removed. Preferably, the fluid may be dispersed at a sufficient pressure to dislodge the particles that may be coating the polishing pad surface and/or clogging the pores of the polishing pad. More specifically, the fluid may be dispensed at a sufficient force to break apart the matter adhered to the polishing pad. In addition, the pressurized fluid may serve to wash away the dislodged material. Furthermore, the nozzles may be arranged such that the fluid is dispersed across the polishing pad. As stated above, the nozzles may be arranged such that the spray distribution from each nozzle overlaps their respective adjacent nozzles. In this manner, the pressurized fluid may contact the polishing pad at a variety of angles.

Such a method may increase the likelihood of dislodging material since the matter is being contacted from multiple directions.

Figure 3B:
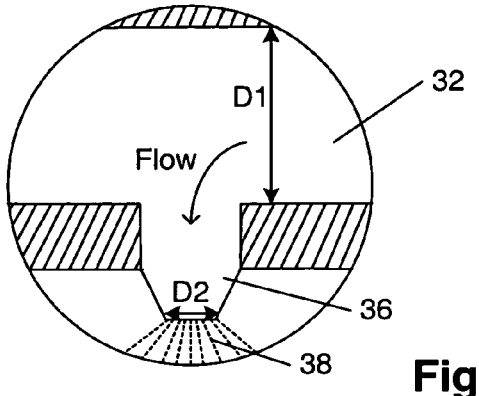
FIG. 3*b* a depicts a partial cross-sectional view of a nozzle within the spray element of FIG. 3*a;*

Portion 35 of spray element 30 is magnified in FIG. 3*b* to illustrate an exemplary configuration of one of nozzles 36. Such an illustration is used to show the restriction of fluid flow from inner pipe 32 through nozzles 36. As shown in FIG. 3*b*, diameter D1 of inner pipe 32 is significantly larger than diameter D2 of the nozzle shown. The restriction of flow from diameter D1 to diameter D2 increases the pressure of fluid flowing through the line, thereby causing pressurized fluid 38 to disperse in a spray pattern from the nozzle shown in FIG. 3*b*. The pressure of pressurized fluid 38 may be between approximately 25 psi and approximately 45 psi. Such a pressure is believed to be sufficient to cause the fluid to spray and contact a polishing pad with enough force such that matter adhered to the polishing pad may be dislodged. In contrast, the pressure of the fluid within inner pipe 32 may only be between approximately 0.3 psi and approximately 3.0 psi. Such a pressure is not believed to be sufficient to cause the fluid to be dispensed in a spray pattern nor dispensed with enough force to dislodge matter adhered to a polishing pad.

Figure 4:
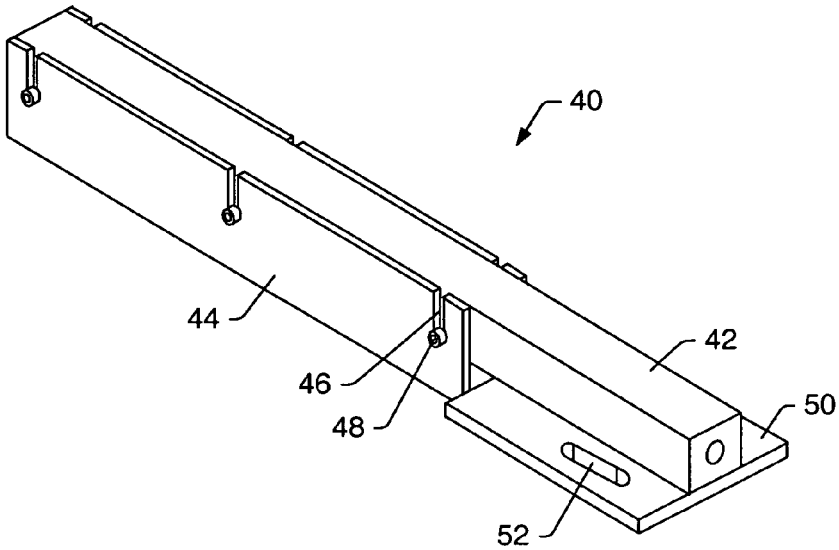
FIG. 4 depicts a perspective view of a spray element including shields and a mounting structure.

A perspective view of an exemplary embodiment of a spray element as described herein is shown in FIG. 4. In particular, spray element 40 is shown with outer casing 42, shields 44 and mounting structure 46. Outer casing 42 may be substantially similar to that of outer casing 34. More specifically, outer casing 42 may be used to encompass an inner pipe leading to a plurality of nozzles similar to the configuration of FIG. 3*a*. The view of FIG. 4 is such that the nozzles of spray element 40 are projected in the downward position. As such, the view of the nozzles is blocked by outer casing 42. In addition, shields 44 may be arranged upon the side of outer casing 42 in order to minimize the spray of the pressurized fluid outside the vicinity of spray element 40. In particular, shields 44 may be spaced adjacent from the nozzles along the side of outer casing 42. Such shields are preferably extended beyond the projection of the nozzles in order to minimize the lateral spray of the pressurized fluid. In an embodiment, shields 44 may extend within approximately 5 mm of the polishing pad. In addition, the position of shields 44 relative to outer casing 42 may be adjusted by sliding shields 44 via slot 46. Upon determining the position of shields 44, fastener 48 may be tightened so that the desired position of shields 44 may be maintained.

Spray element 40 may also include mounting structure 50 with which to mount and support spray element 40 within a polishing system. In an embodiment, mounting structure 50 may contain slot key-hole opening 52 with which to receive a fixed nut of the polishing system and lock the spray element to the system. Such a fixed nut may be positioned anywhere within the polishing system. Mounting structure 50 is preferably configured such that the nozzles of spray element 40 are projected toward the polishing pad of the system upon coupling the spray element to the polishing system. In addition, mounting structure 50 may extend across the bottom portion of spray element 40 as shown in FIG. 4. As such, it is preferable that the nozzles of spray element 40 are positioned only along the part of the spray element that does not include mounting structure 52. In such an embodiment, the part of the spray element that includes the nozzles preferably extends across at least half of the width of the polishing pad. In addition, shields 44 may only be arranged along the portion of outer casing 42 which is adjacent to the nozzles of spray element 40. Mounting structure 50 of FIG. 4 illustrates only one example of how to mount a spray element to a polishing system. As such, other mounting structures and devices, such as clamps and additional support beams, may also be used in order to mount spray element 40 within a polishing system.

Figure 5:
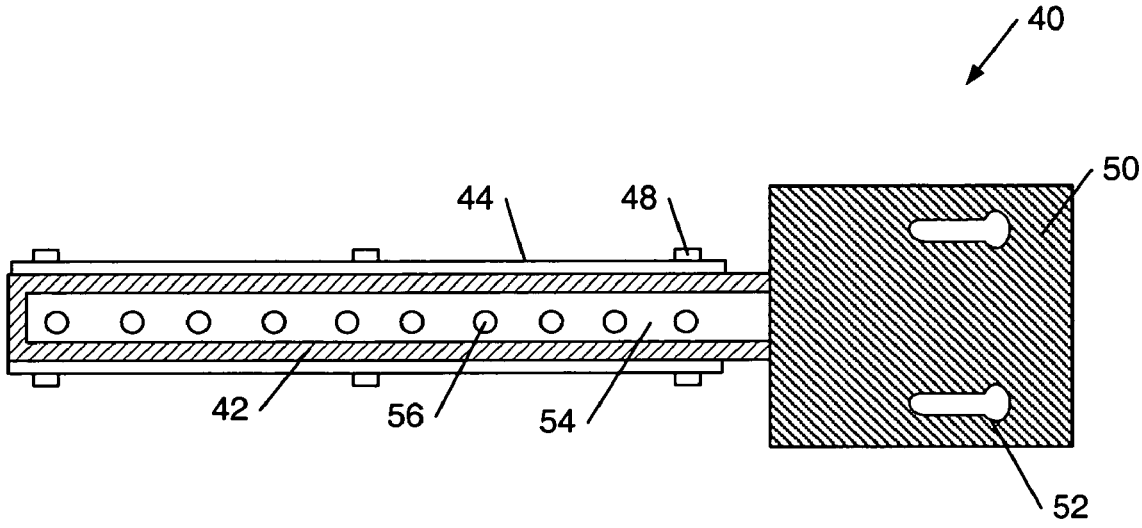
FIG. 5 depicts a partial bottom view of the spray element of FIG. 4.
Figure 6:
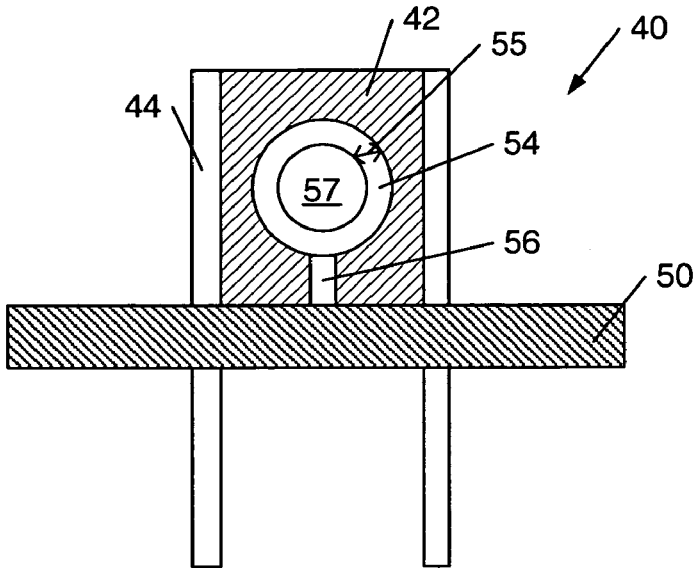
FIG. 6 depicts a side view of the spray element of FIG. 4.

A bottom view of spray element 40 is shown in FIG. 5 to illustrate the arrangement of nozzles 56 in relation to mounting structure 50. As shown in FIG. 5, nozzles 56 may be dispersed along inner tube 54, which may be encompassed by outer casing 42. Shields 44 may be secured to the sides of outer casing 42 by fastener 48. In addition, mounting structure 50 may be arranged at one end of spray element 40. A side view of spray element 40 is illustrated in FIG. 6. In particular, inner tube 54 is shown within outer casing 42 with thickness 55, thereby illustrating opening 57. Although not shown, nozzles 56 within spray element 40 may extend from the lower portion of opening 57 and through inner tube 54. Shields 44 may extend from the upper surface of outer casing 42 beyond the projection of nozzles 56. The vertical position of shields 44 may vary along the sides of outer casing 42 as discussed previously in FIG. 4.

Figure 7:
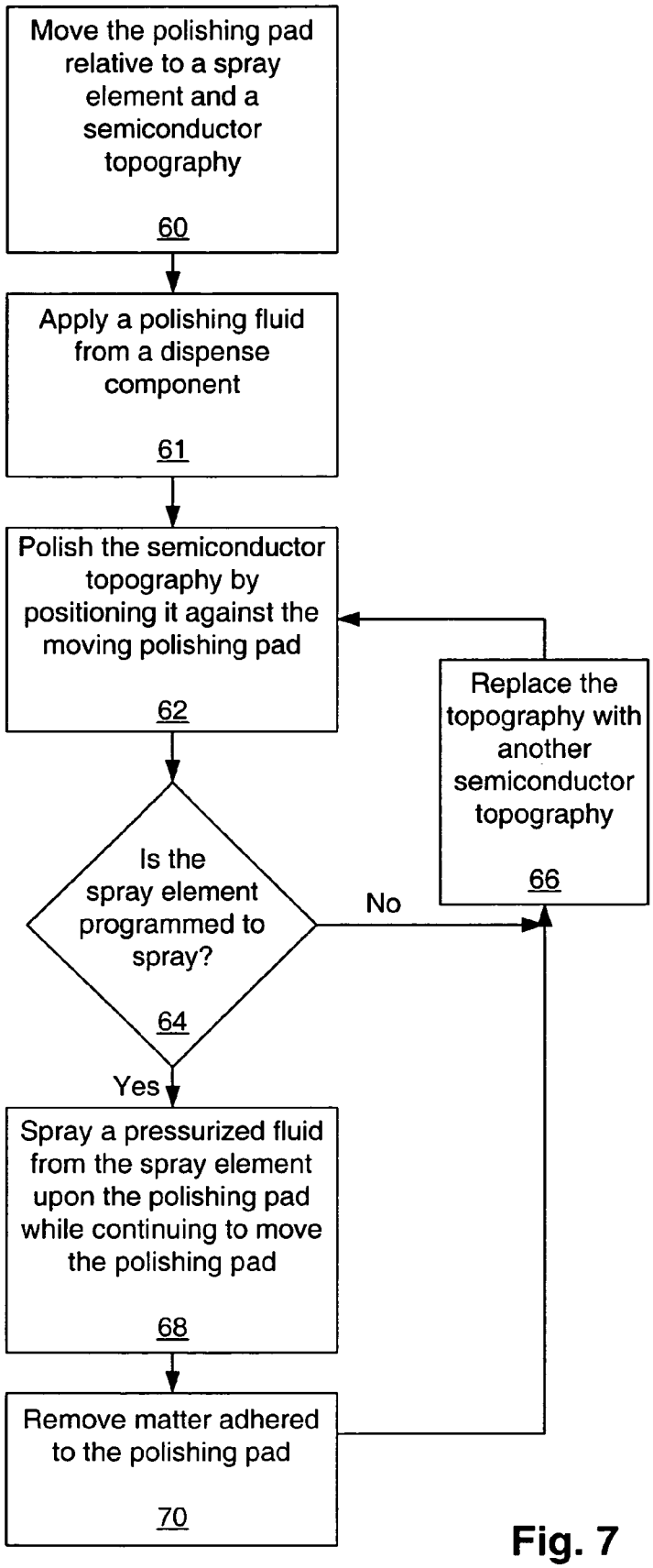
FIG. 7 depicts a method in which matter adhered to a polishing pad of a polishing system is removed during the polishing process.

FIG. 7 illustrates a method of removing matter from a polishing pad using the system as described herein. In particular, the method may include step 60 which includes moving the polishing pad relative to a spray element and a semiconductor topography. A polishing fluid may then be applied to the topography from a dispense component as shown in step 61. Alternatively, a polishing fluid may not be applied to the topography. Continuing to step 62, the semiconductor topography may be polished by positioning it against the moving polishing pad. The method may further include step 64 which determines whether the spray element is programmed to spray at a given time, sequence, or interval. The spray element may be programmed in a variety of manners. For example, the spray element may be programmed to spray at a predetermined time and duration relative to the polishing process of the semiconductor topography. In particular, the spray element may be programmed to start spraying after the topography is polished and until a new topography has been set in place to be polished. Such a program may be set according the process times of the polishing process or by indication switch coupled to the wafer carrier of the polishing system.

In an alternative embodiment, the spray element may be activated by upon accumulating a specific amount of matter upon the polishing pad. Such an accumulation may be monitored in a variety of manners. For example, a measurement of the matter adhered to the pad may be taken periodically during the polishing process by an automated optical scan microscope. Such optical equipment may be incorporated within the polishing system or may be external to the system. In such an embodiment, the spray element may be automatically or manually activated upon measuring a predetermined amount of matter. The predetermined amount may be equivalent to the amount of matter determined to contribute to non-uniform planarity of the polishing system. In another embodiment, planarity measurements of the semiconductor topographies subsequent to the polishing process may taken to indicate when to activate the spray element. In such an embodiment, the spray element may be automatically or manually activated upon obtaining a planarity measurement outside a predetermined range. Such a predetermined range is preferably within and smaller than the design specification range of the topography. Another method of determining when to activate the spray element may include visually inspecting the polishing pad during the polishing process. Such a method, however, may require manual activation of the spray element. As such, visual inspection of the polishing pad may not facilitate timely and consistent activation of the spray element.

The duration of spraying the pressurized fluid may vary depending on the design specifications of the system. For example, the spray element may spray the pressurized fluid for a duration between approximately 1 second and approximately 4 minutes. More specifically, the duration of spraying may vary between approximately 5 seconds and 1 minute. In one embodiment, the spray element may spray the pressurized fluid for approximately 10 seconds. Based on typical rotation rates of between approximately 10 rpm and 90 rpm for CMP polishing pads, the polishing pad may make between 2 and 15 revolutions during such a 10 second duration. Consequently, a 10 second duration may insure that the pressurized fluid comes in contact with every portion of the polishing pad during each activation of the spray element.

In a preferred embodiment, the spray element may not be activated during the polishing process so that the fluid dispersed from the spray element may not dilute the slurry used to polish the topography. Generally, replacing a topography with a new topography may take from approximately 1 minute to approximately 4 minutes. As such, the spray element may be activated during that time. In an alternative embodiment, the spray element may be activated at the same time the semiconductor topography is being polished. In some embodiments, the spray element may be activated in a pulsing sequence. In such an embodiment, the spray element may be programmed to be activated, terminated, and reactivated in a given amount of time. For example, the spray element may be activated for approximately 1 second to approximately 1 minute. The spray element may then be placed in standby mode for approximately 1 second to approximately 1 minute before being reactivated. In a preferred embodiment, the spray element may be programmed to pulse between activation mode of approximately 10 seconds and standby mode for approximately 5 seconds.

In the event that the spray element is not programmed to spray, the topography positioned within the system may be replaced by another semiconductor topography as shown in step 66. The method may then continue through steps 61 and 64 as described above. Upon a time when the spray bar is programmed to spray, the method may continue to step 68 to spray a pressurized fluid from the spray element while continuing to move the polishing pad. Consequently, the method may include removing matter adhered to the polishing pad as shown in step 70. Either after or during steps 68 and 70, the polished topography may be replaced by another semiconductor topography. In this manner, the method of removing matter adhered to the polishing pad may be conducted while the polishing system is activated. In other words, the polishing system does not have to be shut down to remove matter adhered to the polishing pad.

There may be several polish/spray scenarios with which to polish a plurality of semiconductor topographies with the polishing system as described herein. For example, the spray element may be activated after polishing each semiconductor topography. In this manner, the matter adhered to the polishing pad may be removed after polishing each semiconductor topography. In another embodiment, a plurality of topographies may be polished before activating the spray element to remove matter adhered to the polishing pad. The number of topographies polished activating the spray element may vary depending on the design specifications of the semiconductor topography. More specifically, the planarity tolerance specifications of the devices made from the polished semiconductor topography may determine the sequence of the polish/spray process flow. In addition, the capability and effectiveness of the polishing system may be a factor in determining the optimum polish/spray process flow. Factors which may also contribute to such capability and effectiveness may include, for example, the type of polishing pad medium, the rate of movement of the polishing pad and/or semiconductor topography, the material that is being polished, and the type of slurry used.

A comparison of some of the distinguishing elements and benefits of the system and method as described herein as compared to conventional processes and methods is shown in Table 1 below. For example, using the system as described herein may allow matter to be removed from the polishing pad without shutting down the polishing system. More specifically, the spray element may be activated during or in between polishing of one or more semiconductor topographies. As such, the method as described herein may require less downtime and thereby increase production throughput as compared to conventional processes. In addition, matter adhered to the polishing pad may be more frequently removed with the system as described herein since the polishing system does not have to be shut down to clean the pad. For example, matter may be removed from the pad between polishing each semiconductor topography or between one or more topographies. Another advantage of the presently claimed method is that the life of the polishing pad may be extended. In particular, the life of the polishing pad may be extended by approximately 10% or more as compared to a similar polishing pad used in a conventional system. For example, if a polishing pad has a pad life of approximately 13 polishing hours, then the same polishing pad may have a pad life of approximately 14.5 polishing hours or more.

The system and method as described herein may also clean the pad more consistently than as compared to manual conventional methods, which typically depend on operator intervention. The automatic process of the system as described herein consistently removes matter adhered to the polishing pad due to the force of the pressurized fluid. The consistent cleaning process may allow the surface tilt of semiconductor topographies to be more uniform from wafer to wafer. Surface tilt may be defined as the variation in the amount of material upon a plurality of topographies subsequent to the polishing process. Such an amount may be determined by measuring the thickness of a polished layer upon the topography. In an instance in which the polished topography includes structures dispersed across the topography, the surface tilt may be determined by measuring the thickness of one or more of the structures across the topography.

The more uniform the surface tilt is between a plurality of topographies, the higher the probability that such topographies are within their design specifications. Such an increase in the number of topographies within their design specifications produces less "problem lot" topographies. "Problem lot" topographies may be defined as topographies which do not meet their design specifications. Such topographies must be reviewed as to whether to accept the topography, rework the topography, or scrap the topography. Such determination requires valuable time and resources. As such, with a reduction in the number of "problem lot" topographies, processing time and fabrication costs may be reduced. In addition, with an increase in the number of topographies within specification, the process capability of the system may be improved. For example, the process capability of the system as described herein may have approximately 25% to approximately 40% better process capability than conventional systems. In particular, the process as described herein may form approximately 25% to approximately 40% more topographies within design specifications than with a system without a spray element.

TABLE 1

Comparison of Conventional Polishing systems to the System and Method as Described Herein

| Conventional Systems | New System |
|---|---|
| Requires the polishing system to shutdown to clean pad | Able to clean without shutting down the polishing system |
| Due to time constraints, the pad is typically cleaned after each lot of topographies | Able to clean the pad at any time (e.g., between each topography or a plurality of topographies) |
| Approximately 13 polishing hours of pad life | Approximately 14.5 polishing hours of pad life (~10% improvement in pad life) |
| Inconsistent cleaning | Consistent cleaning |
| Significant amount of surface tilt | Reduced amount of surface tilt |
| Significant number of topography lots out of specification | Reduced number topography lots out of specification |
| Significant processing costs due to downtime of the Polishing system | Reduced costs due to reduced downtime |
| Low production throughput due to downtime of the Polishing system | Increased production throughput due to reduced downtime |
| Poor process capability | 25% to 40% improved process capability |

It will be appreciated to those skilled in the art having the benefit of this disclosure that this invention is believed to provide a method and a system for cleaning a polishing pad. Further modifications and alternative embodiments of various aspects of the invention will be apparent to those skilled in the art in view of this description. For example, the system as described herein may be applied to a polishing system which is adapted to polish a plurality of topographies. In addition, the system may be used for polishing a variety of materials, such as dielectric and conductive materials. It is intended that the following claims be interpreted to embrace all such modifications and changes and, accordingly, the drawings and the specification are to be regarded in an illustrative rather than a restrictive sense.

What is claimed is:

1. A polishing system, comprising:

a polishing pad;

a spray element adapted to spray a pressurized fluid upon the polishing pad to remove matter adhered to the pad, wherein said matter is adhered to the polishing pad during a polishing process of a semiconductor topography, and wherein the spray element is configured to be arranged adjacent to an edge of the semiconductor topography which the polishing pad is moving away from during the polishing process; and a dispense component adapted to dispense a polishing fluid onto the polishing pad during said polishing process, wherein the dispense component is configured to be arranged adjacent to an opposite edge of the semiconductor topography which the polishing pad is moving toward during the polishing process.

2. The system of claim 1, wherein said matter comprises particles from the polishing fluid.

3. The system of claim 1, wherein said matter comprises particles from the semiconductor topography.

4. The system of claim 1, adapted to allow the pressurized fluid to be dispensed across the entirety of the polishing pad.

5. The system of claim 1, wherein the spray element is positioned across at least half of the width of the polishing pad.

6. The system of claim 5, wherein the polishing pad comprises a circular pad and the spray element extends across the radius of the polishing pad.

7. The system of claim 5, wherein the polishing pad comprises a belt and the spray element extends across the width of the belt.

8. The system of claim 1, wherein said polishing pad comprises a plurality of pores, and wherein a portion of the matter is embedded within one or more of the pores.

9. A spray element adapted to be positioned within a polishing system and further adapted to remove matter adhered to a polishing pad of the system by spraying a pressurized fluid upon the polishing pad, wherein the spray element comprises:

a plurality of nozzles configured to spray the pressurized fluid; and one or more adjustable shields arranged about the plurality of nozzles and configured to move independent of an arm comprising the nozzles.

10. The spray element of claim 9, wherein the spray element is adapted to be positioned within the polishing system such that the pressurized fluid is dispersed across a region extending across at least half of the width of the polishing pad.

11. The spray element of claim 9, wherein a spray distribution from one of said plurality nozzles overlaps a spray distribution from an adjacent nozzle.

12. The spray element of claim 9, wherein said shields are arranged along the sides of the spray element parallel to the projection of the nozzles.

13. The spray element of claim 9, comprising a mounting structure with which to couple the spray element to the polishing system.

14. A method for cleaning a polishing pad, comprising:

moving the polishing pad relative to a spray element, wherein the spray element and polishing pad are positioned within a polishing system such that fluid openings of the spray element are positioned toward the polishing pad;

spraying a pressurized fluid in a pulsating sequence from the spray element upon the polishing pad during said moving; and removing matter adhered to the polishing pad.

15. The method of claim 14, wherein said spraying is conducted after polishing one or more semiconductor topographies with the polishing system.

16. The method of claim 14, wherein the duration of said spraying is sufficient such that the pressurized fluid is dispensed across the entire upper surface of the polishing pad.

17. The method of claim 14, wherein said spraying comprises spraying the fluid at a sufficient pressure to dislodge the matter adhered to the polishing pad.

18. The method of claim 14, wherein said spraying comprises spraying the fluid at a pressure between approximately 25 psi and approximately 45 psi.

* * * * *

UNITED STATES PATENT AND TRADEMARK OFFICE

CERTIFICATE OF CORRECTION

PATENT NO. : 7,014,552 B1
APPLICATION NO. : 09/899871
DATED : March 21, 2006
INVENTOR(S) : Collier et al.

It is certified that error appears in the above-identified patent and that said Letters Patent is hereby corrected as shown below:

In the Claims:

Please add the following claims which were allowed during prosecution of the patent application, but were mistakenly omitted from the printed patent:

Claim 19. (original claim 10) The system of claim 1, wherein the spray element is adapted to be removed from the system.

Claim 20. (previously presented claim 23) A method for polishing multiple semiconductor topographies, comprising:

moving a polishing pad with respect to a semiconductor topography and a spray element;

polishing the semiconductor topography by positioning it against the moving polishing pad;

measuring an amount of matter adhered to the polishing pad subsequent to said polishing;

spraying a pressurized fluid from the spray element upon the polishing pad while moving the polishing pad, wherein said spraying is conducted based upon the amount of matter measured; and removing matter adhered to the polishing pad.

Claim 21. (previously presented claim 24) The method of claim 20, further comprising polishing one or more additional topographies prior to said measuring.

Claim 22. (previously presented claim 22) The method of claim 14, wherein said spraying is conducted simultaneously with polishing one or more semiconductor topographies with the polishing system.

Claim 23. (original claim 28) The method of claim 21, further comprising applying a polishing fluid from a dispense component prior to said polishing.

UNITED STATES PATENT AND TRADEMARK OFFICE

CERTIFICATE OF CORRECTION

PATENT NO. : 7,014,552 B1
APPLICATION NO. : 09/899871
DATED : March 21, 2006
INVENTOR(S) : Collier et al.

It is certified that error appears in the above-identified patent and that said Letters Patent is hereby corrected as shown below:

Col. 18 lines 22-23: please delete the text "and configured to move independent of an arm comprising the nozzles" since this phrase was not included in the claim when allowed.

Signed and Sealed this

Twenty-ninth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,014,552 B1
APPLICATION NO. : 09/899871
DATED : March 21, 2006
INVENTOR(S) : Collier et al.

It is certified that error appears in the above-identified patent and that said Letters Patent is hereby corrected as shown below:

In the Claims:

Column 14, line 63,

Please add the following claims which were allowed during prosecution of the patent application, but were mistakenly omitted from the printed patent:

Claim 19. (original claim 10) The system of claim 1, wherein the spray element is adapted to be removed from the system.

Claim 20. (previously presented claim 23) A method for polishing multiple semiconductor topographies, comprising:

moving a polishing pad with respect to a semiconductor topography and a spray element;

polishing the semiconductor topography by positioning it against the moving polishing pad;

measuring an amount of matter adhered to the polishing pad subsequent to said polishing;

spraying a pressurized fluid from the spray element upon the polishing pad while moving the polishing pad, wherein said spraying is conducted based upon the amount of matter measured; and removing matter adhered to the polishing pad.

Claim 21. (previously presented claim 24) The method of claim 20, further comprising polishing one or more additional topographies prior to said measuring.

Claim 22. (previously presented claim 22) The method of claim 14, wherein said spraying is conducted simultaneously with polishing one or more semiconductor topographies with the polishing system.

Claim 23. (original claim 28) The method of claim 21, further comprising applying a polishing fluid from a dispense component prior to said polishing.

UNITED STATES PATENT AND TRADEMARK OFFICE

CERTIFICATE OF CORRECTION

PATENT NO. : 7,014,552 B1
APPLICATION NO. : 09/899871
DATED : March 21, 2006
INVENTOR(S) : Collier et al.

It is certified that error appears in the above-identified patent and that said Letters Patent is hereby corrected as shown below:

Col. 18 lines 22-23: please delete the text "and configured to move independent of an arm comprising the nozzles" since this phrase was not included in the claim when allowed.

This certificate supersedes the Certificate of Correction issued April 29, 2008.

Signed and Sealed this

Twentieth Day of May, 2008

JON W. DUDAS
*Director of the United States Patent and Trademark Office*